US006149410A

United States Patent [19]

Cooper

[11] Patent Number: 6,149,410

[45] Date of Patent: Nov. 21, 2000

[54] REVERSIBLE GEROTOR PUMP HAVING MAGNETIC ATTRACTION BETWEEN THE ROTOR AND THE REVERSING RING

[75] Inventor: John Cooper, Herts, United Kingdom

[73] Assignee: Lucas Industries plc, United Kingdom

[21] Appl. No.: 09/362,168

[22] Filed: Jul. 27, 1999

[51] Int. Cl.[7] ..... F04C 2/10; F04C 15/02

[52] U.S. Cl. ..... 418/32; 418/166

[58] Field of Search ..... 418/32, 166, 171; 417/315

[56] References Cited

U.S. PATENT DOCUMENTS 1,964,330 6/1934 Pitt ..... 418/32

4,171,192 10/1979 Taylor et al. ..... 418/32

4,200,427 4/1980 Binger et al. ..... 418/32

4,222,719 9/1980 Johnson ..... 418/32

*Primary Examiner*—John J. Vrablik

*Attorney, Agent, or Firm*—Andrus, Sceales, Starke & Sawall

[57] ABSTRACT

A reversible gerotor-type pump having an angularly moveable reversing ring rotatably supporting an internally toothed rotor which in turn cooperates with an externally toothed gear received within the rotor and rotatable therewith about an axis parallel to but spaced from the axis of rotation of the rotor, and, magnet means magnetically attracting the rotor towards the reversing ring so as to provide drag between the rotor and the reversing ring at least at the commencement of rotation of the rotor relative to the reversing ring.

6 Claims, 1 Drawing Sheet

Figure 1:
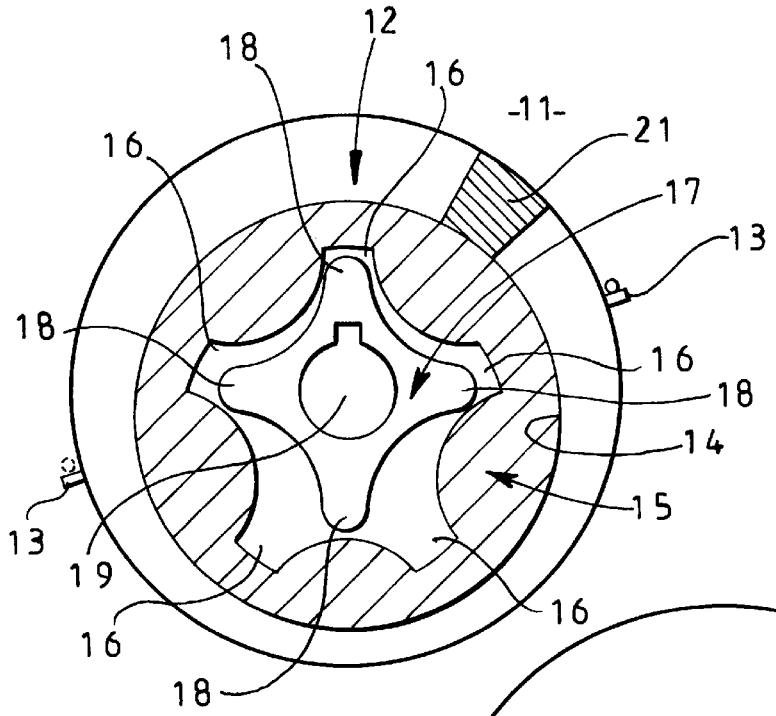

REVERSIBLE GEROTOR PUMP HAVING MAGNETIC ATTRACTION BETWEEN THE ROTOR AND THE REVERSING RING

This invention relates to reversible gear pumps of the kind often referred to as reversible gerotor pumps.

Reversible gerotor pumps are well known, and include an externally toothed gear surrounded by, and meshing with, an internally toothed rotor. The gear and rotor rotate together in the same direction about spaced parallel axes, and the gear generally has one fewer teeth than the meshing form on the inner surface of the rotor. The shaping of the tooth forms on the gear and the rotor is such that as the two rotate together, the shaping, and number of teeth, together with the eccentricity of the rotation axes of the gear and the rotor produce a pumping action.

It is well known that if the direction of rotation of the gear and rotor is reversed then the pumping action is reversed in that the pump inlet becomes a pump outlet and vice versa. It is also well known that if the eccentricity of the axes of the gear and rotor is reversed then again the pumping flow is correspondingly reversed. This knowledge has been made use of in a number of reversible gerotor pump constructions in which reversal of rotation of the gear and rotor is accompanied by reversal of the eccentricity so that irrespective of the change in rotation direction the pumping flow direction stays the same, and the pump inlet remains an inlet while the pump outlet remains an outlet.

Conventionally eccentricity reversal is achieved by movement of a reversing ring within which the rotor of the pump is mounted. The reversing ring is mounted for rotation about an axis co-extensive with the axis of the gear of the pump and has an eccentrically positioned cylindrical bore within which the cylindrical outer surface of the pump rotor is received. Thus the angular position of the reversing ring determines the eccentricity of the rotor relative to the gear and moving the ring relative to the rotor through 180° reverses the eccentricity of the rotor relative to the gear. Conventionally frictional drag between the rotor and the reversing ring moves the reversing ring when reversal of the rotation of the rotor takes place, an outer housing providing abutments cooperating with the reversing ring to limit the movement of the reversing ring to 180°. There are many variations of such arrangements, and three different examples are illustrated respectively in U.S. Pat. Nos. 4,171,192, 4,200,427 and 4,222,719.

It will be recognised that where the supply of liquid from the pump is crucial, as can be the case where the pump is pumping lubricating oil to a critical, high speed, component such as an electrical generator of an aircraft gas turbine engine, then any delay in pumping could be disastrous. The three patents mentioned above disclose different ways of ensuring that there is sufficient drag between the rotor and the reversing ring to ensure that the reversing ring is driven against its appropriate abutment immediately the rotor commences rotation. Such solutions to augmenting the drag between the rotor and the reversing ring may well be suitable for non-critical applications, but since each involves the provision of a friction enhancing device linking the rotor to the reversing ring then each carries with it the risk of wear of the sliding interface, and the risk of fracture of the friction enhancing component. Such wear and/or fracture can be extremely disadvantageous in that it may result in the loss of drag between the rotor and the reversing ring so that the reversing ring is not driven immediately against its abutment when rotation of the rotor commences, and thus there can be a delay in the supply of liquid from the pump. Moreover, wear and/or fracture can give rise to contaminants in the liquid flow from the pump and contaminants which could, conceivably, prevent appropriate movement of the reversing ring relative to the outer housing.

It is an object of the present invention to provide, in a simple and convenient form, a reversible gerotor type pump in which the aforementioned difficulties are minimised or obviated.

In accordance with the present invention there is provided a reversible gerotor-type pump having an angularly moveable reversing ring rotatably supporting an internally toothed rotor which in turn cooperates with an externally toothed gear received within the rotor and rotatable therewith about an axis parallel to but spaced from the axis of rotation of the rotor, and, magnet means magnetically attracting the rotor towards the reversing ring so as to provide drag between the rotor and the reversing ring at least at the commencement of rotation of the rotor relative to the reversing ring.

Preferably said magnet means comprises a region of said reversing ring which has been treated to render it magnetic.

Alternatively said magnet means comprises an insert of permanent magnet material received in a pocket in the face of the reversing ring presented to the rotor.

As a further alternative said magnet means comprises an insert of permanent magnet material received in a pocket in the face of the rotor presented to the reversing ring.

Desirably where said magnet means is an insert of permanent magnet material then said insert is set fractionally below the cylindrical surface of the reversing ring or the rotor so as not to be in rubbing contact with the rotor or reversing ring.

Figure 2:
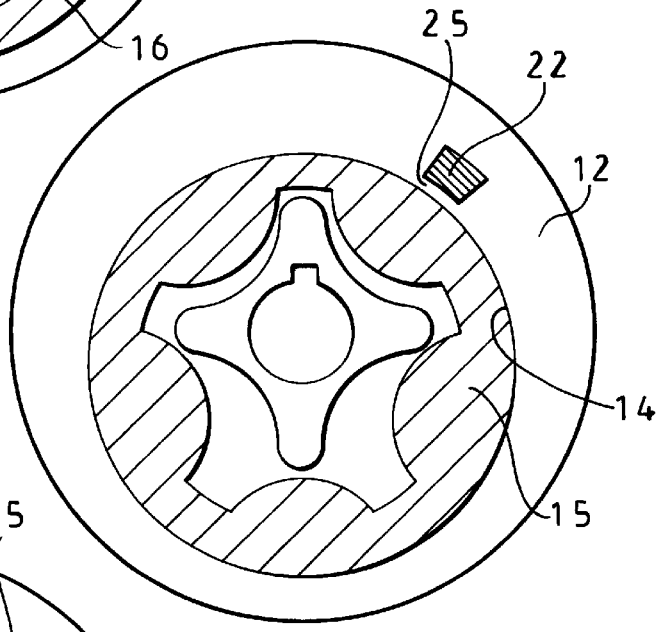
Figure 3:
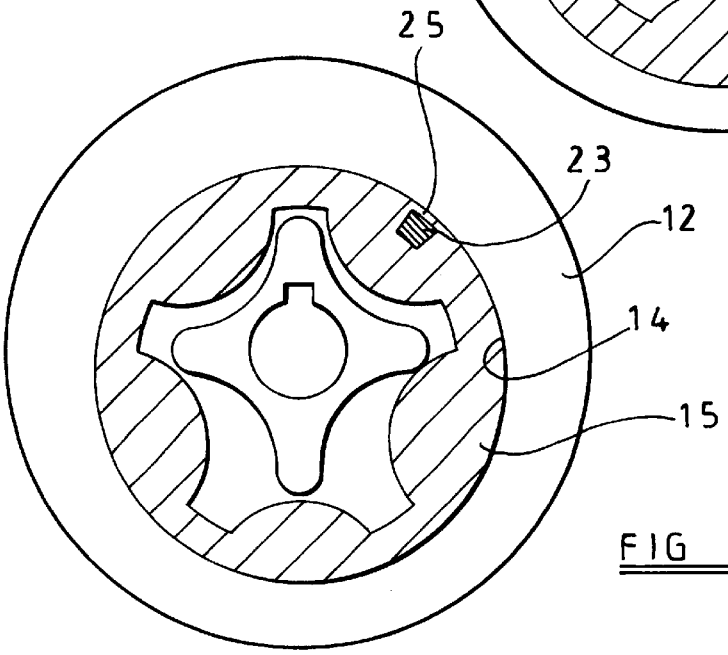

In the accompanying drawings:

FIG. 1 is a diagrammatic cross-sectional view of a gerotor-type pump in accordance with one example of the present invention, and FIGS. 2 and 3 are views similar to FIG. 1 of first and second alternatives respectively.

Referring first to FIG. 1 of the accompanying drawings it can be seen that the reversible gerotor-type pump is generally of conventional form comprising a circular-cylindrical reversing ring 12 rotatably supported within a fixed pump housing 11. The housing 11 and reversing ring 12 incorporate stop means 13 of any convenient form limiting rotational movement of the ring 12 in the housing 11 to an angular movement of 180°.

The ring 12 has a circular cylindrical bore 14 the axis of which is parallel to, but offset from, the axis of rotation of the ring 12 in the housing 11. Thus the bore 14 is eccentric in relation to rotation of the ring 12.

The ring 12 is formed from a wear-resistant, ferromagnetic material and rotatably receives a circular-cylindrical pump rotor 15 formed from a similar material. The outer cylindrical surface of the rotor 15 is a close, sliding fit within the cylindrical bore 14 of the ring 12, and the interface of the rotor 15 and ring 12 is lubricated in use. In the preferred embodiment the pump is an oil pump, and thus a supply taken from the output of the pump can be directed to the interface of the rotor 15 and ring 12 for lubrication purposes.

The rotor 15 is shaped internally to define a gear-form having five equiangularly spaced recesses 16. Positioned within the rotor 15 is a gear 17 having four equi-angularly spaced lobes 18.

The gear 17 is keyed to a shaft 19 having its rotational axis co-extensive with the rotational axis of the ring 12. The rotor 15 is driven for rotation with the shaft 19 but of course rotates about an axis eccentric to the axis of the shaft 19 and gear 17.

As is well understood the progression of the lobes 18 of the gear 17 from recess 16 to recess 16 as the gear and rotor rotate together, produces in conjunction with the shaping of the gear 17 and the internal gear form of the rotor 15, displacement of liquid filling the space between the gear 17 and the internal gear form of the rotor 15, from an outlet (not shown) of the pump, while drawing liquid from a supply into the rotor 15 through a corresponding pump inlet (not shown).

As is conventional, reversal of the rotation direction of the rotor and gear pumps the liquid in the opposite direction so that the inlet of the pump becomes an outlet, and the outlet of the pump becomes an inlet. Similarly, reversal of the eccentricity of the arrangement, by rotating the ring 12 through 180°, also reverses the pumping action, and so if it is desired to maintain the pumping direction unchanged, while reversing the direction of rotation of the gear 17 and rotor 15, then the reversing ring 12 must be rotated through 180°.

In known gerotor-type pumps the movement of the reversing ring 12 between its alternative 180° abutment positions is generated by drag between the rotor 15 and the ring 12. Thus if the rotor 15 rotates in a clockwise direction the ring 12 is dragged with the rotor in a clockwise direction until the appropriate abutments are operative to prevent further movement of the ring 12 whereupon the rotor rotates relative to the ring. Similarly rotation of the rotor 15 in the opposite direction drags the ring 12 in the opposite direction through 180° until the abutments 13 are effective to stop further rotation of the ring.

Where the supply of fluid from the pump is critical, it is essential that the initial movement of the rotor 15 in either direction either drives the ring 12 to its appropriate abutment position, or ensures that the ring 12 is in that position. However, frictional drag between the rotor 15 and the ring 12 may be ineffective if the interface between the ring 12 and rotor 15 is well lubricated, but alternatively in the event that there is high friction between the rotor 15 and the ring 12 then in use this will rapidly give rise to wear reducing the drag, and risking the introduction of particles of metal from the rotor 15 and/or the ring 12 into the oil supply. Such contaminants may have a disastrous effect on the equipment supplied with liquid by the pump, and could also find their way into the interface between the ring 12 and the housing 11 thus preventing movement of the ring relative to the housing.

In FIG. 1 a region 21 of the ring 12 has been treated to render it magnetic. Thus in the static condition of the rotor the magnetic attraction of the ring 12 to the rotor will minimise the clearance between the ring and the rotor, thereby ensuring that when the rotor commences rotation there is sufficient drag between the rotor and the ring for the ring 12 to move with the rotor until it is arrested by the respective abutment arrangement 13. Thereafter, as the rotor 15 rotates within the ring the film of lubricant between the rotor 15 and the ring, which was displaced or thinned by the magnetic attraction pulling the ring and the rotor together, will be restored thus centering the rotor 15 within the bore 14 of the ring 12 and minimising wear between the ring and the rotor. Viscous drag within the oil film between the ring and the rotor will ensure that the ring remains driven against the respective abutment 13.

In FIG. 1 the magnetic region 21 is an integral region of the ring 12 the material of which has been rendered magnetic by appropriate treatment. In FIG. 2 the magnetic attraction between the ring 12 and the rotor 15 is provided by an insert of permanent magnet material 22 received in a pocket in the wall of the bore 14 of the ring 12. FIG. 3 illustrates an alternative arrangement in which the magnetic means attracting the ring 12 to the rotor 14 is defined by an insert 23 of permanent magnet material housed in a pocket in the outer surface of the rotor 15.

Where permanent magnet material inserts are utilized, as illustrated in FIGS. 2 and 3, it will be recognised that the inserts will be permanently bonded into their respective pockets by a suitable adhesive material, or some form of mechanical fixing arrangement. Various permanent magnet materials would be suitable, but rare-earth materials are preferred. For example, a cobalt-samarium material might be used. It is recognised that permanent magnet materials are generally rather brittle, and thus to avoid the risk of permanent magnet material being abraded from the inserts 22, 23 when the rotor 15 rotates relative to the ring 12, it is desirable to recess the inserts 22, 23 fractionally below the cylindrical surface of the ring 12 or rotor 15 so that a gap 25 exists and there is no contact between the insert and the opposite component during relative rotation. The degree of drag may be adjusted by varying the magnetic attraction between the rotor 15 and the ring 12, and this can be achieved by adjusting the dimensions of the gap 25.

Reversible gerotor-type pumps of the kind described above with reference to FIGS. 1, 2 and 3 are particularly useful in supplying cooling/lubricating lubricating oil to aircraft gas turbine engine electrical generators. Each generator may incorporate a gerotor-type pump, the rotor 15 and gear 17 of which rotor with the shaft of the generator. Each engine may drive a pair of generators, and because of mounting requirements the two generators of the engine may be required to rotate in opposite directions. It will be understood that gerotor-type pumps of the kind described above with reference to FIGS. 1 to 3 can be used in either of the two generators without modification since they will accommodate rotation of the rotor in either direction, and in each case the ring 12 will be driven against the correct abutments 13 by the rotation of the respective rotor and thereafter the rotor will rotate within each respective ring in a very low friction relationship by virtue of the restoration of the oil film disrupted by the magnetic attraction when the rotor and ring are stationary.

I claim:

1. A reversible gerotor-type pump having an angularly moveable reversing ring rotatably supporting an internally toothed rotor which in turn cooperates with an externally toothed gear received within the rotor and rotatable therewith about an axis parallel to but spaced from the axis of rotation of the rotor, and, magnet means magnetically attracting the rotor towards the reversing ring so as to provide drag between the rotor and the reversing ring at least at the commencement of rotation of the rotor relative to the reversing ring.

2. A reversible gerotor-type pump as claimed in claim 1, wherein said magnet means comprises a region of said reversing ring which has been treated to render it magnetic.

3. A reversible gerotor-type pump as claimed in claim 1, wherein said magnet means comprises an insert of permanent magnet material received in a pocket in the face of the reversing ring presented to the rotor.

4. A reversible gerotor-type pump as claimed in claim 1, wherein said magnet means comprises an insert of permanent magnet material received in a pocket in the face of the rotor presented to the reversing ring.

5. A reversible gerotor-type pump as claimed in claim 3, wherein said magnet means is set fractionally below the cylindrical surface of the reversing ring so as not to be in rubbing contact with the rotor.

6. A reversible gerotor-type pump as claimed in claim 4, wherein said magnet means is set fractionally below the cylindrical surface of the rotor so as not to be in rubbing contact with the reversing ring.

* * * * *

UNITED STATES PATENT AND TRADEMARK OFFICE

CERTIFICATE OF CORRECTION

PATENT NO. : 6,149,410
DATED : November 21, 2000
INVENTOR(S) : John Cooper

It is certified that error appears in the above-identified patent and that said Letters Patent is hereby corrected as shown below:

[30] Foreign Application Priority Data
August 15, 1998 [GB] United Kingdom 9811739.7

Signed and Sealed this

Twelfth Day of June, 2001

Nicholas P. Godici

*Attest:*

NICHOLAS P. GODICI

*Attesting Officer*

*Acting Director of the United States Patent and Trademark Office*